US008529421B2

(12) United States Patent
Fallas

(10) Patent No.: US 8,529,421 B2
(45) Date of Patent: Sep. 10, 2013

(54) PACKAGE FLAP FOLDING METHOD AND APPARATUS

(76) Inventor: Richard J. Fallas, Woodway, TX (US)

( * ) Notice: Subject to any disclaimer, the term of this patent is extended or adjusted under 35 U.S.C. 154(b) by 629 days.

(21) Appl. No.: 12/689,314

(22) Filed: Jan. 19, 2010

(65) Prior Publication Data

US 2011/0177928 A1 Jul. 21, 2011

(51) Int. Cl.
*B31B 1/48* (2006.01)

(52) U.S. Cl.
USPC ..... 493/70; 493/72; 493/423; 53/491

(58) Field of Classification Search
USPC ..... 493/394, 405, 416, 422, 423, 441, 493/70–72; 53/484, 491
See application file for complete search history.

(56) References Cited

U.S. PATENT DOCUMENTS

| | | | | |
|---|---|---|---|---|
| 1,922,412 | A | | 8/1933 | Allen |
| 2,584,925 | A | | 2/1952 | Rideout |
| 2,974,461 | A | | 3/1961 | Demler |
| 2,993,319 | A | | 7/1961 | Gaubert |
| 3,253,389 | A | | 5/1966 | Miller |
| 3,354,606 | A | | 11/1967 | Miller |
| 3,466,843 | A | * | 9/1969 | Mumper ..... 53/136.4 |
| 3,618,479 | A | | 11/1971 | Shields |
| 3,623,293 | A | | 11/1971 | Boulay |
| 3,762,129 | A | | 10/1973 | Salomon |
| 3,769,777 | A | | 11/1973 | Miller |
| 3,894,380 | A | * | 7/1975 | Poulsen ..... 53/75 |
| 4,079,572 | A | | 3/1978 | Vande Castle |
| 4,144,694 | A | | 3/1979 | Stapp |
| 4,672,792 | A | | 6/1987 | Wallin |
| 4,815,252 | A | | 3/1989 | Renard |
| 5,092,827 | A | * | 3/1992 | McAdam et al. ..... 493/179 |
| 5,797,831 | A | | 8/1998 | Roberts |
| 6,252,181 | B1 | | 6/2001 | Fallas |
| 6,301,859 | B1 | | 10/2001 | Nakamura |
| 6,729,105 | B2 | | 5/2004 | Spatafora |
| 6,910,314 | B2 | * | 6/2005 | Le ..... 53/136.4 |
| 7,278,248 | B2 | * | 10/2007 | Vinh Le ..... 53/136.4 |

FOREIGN PATENT DOCUMENTS

| | | |
|---|---|---|
| JP | 10297617 A | 11/1998 |

* cited by examiner

*Primary Examiner* — Christopher Harmon
(74) *Attorney, Agent, or Firm* — Ballard Spahr LLP

(57) ABSTRACT

An apparatus for folding the flaps of a package is provided. The apparatus has a pair of folding conveyors positioned such that, as a package having open major flaps is urged towards the folding conveyors, the folding conveyors fold the major flaps of the case to a closed position. The apparatus has a front flap mechanism configured to close the front flap of the package, and a rear flap mechanism configured to close the rear flap of the package.

14 Claims, 6 Drawing Sheets

PACKAGE FLAP FOLDING METHOD AND APPARATUS

FIELD OF THE INVENTION

Provided are methods and apparatuses for folding the flaps of a package. More specifically, provided are methods and apparatuses for folding the flaps of a package comprising at least one powered belt.

BACKGROUND

A common corrugated box used in packaging is the Regular Slotted Case ("RSC"). A conventional RSC has two major flaps running the length of the case (in the longer direction) and two minor flaps running the width of the case (in the shorter direction). When the flaps are folded to close the case, the major flaps overlie the minor flaps.

The conventional method for folding the major flaps is with stationary plows. As the case is conveyed toward a closing device, the stationary plows contact the major flaps and force them to a closed position. A disadvantage to this method is the friction produced between the plows and the flaps, which can be especially pronounced if the case is a heavy duty double walled case or if the case has been overfilled. This friction can distort the case causing an uneven fold. Another disadvantage is if the case is not perfectly centered between the two stationary plows (there is one plow per major flap), the case tends to skew because one flap begins to fold (and therefore be pulled back) by the plow before the other flap makes contact with the other plow.

As an alternative to stationary plows, a mechanism which uses a pair of major case flap closer bars connected to a pair of pneumatic cylinders can be used. This is a more positive way of closing the major flaps; however, there is still friction between the case and the folding bars. Once again, this becomes very obvious if the case has been overfilled. Also, this mechanism can be cost-prohibitive.

The conventional method to fold the front and rear minor flaps uses a stationary plow located at the upstream end of the machine to fold the front minor flap. Again, friction is undesirably created between the flap and the plow. The front minor flap is held closed with a stationary horizontal guide. The rear minor flap is then folded with an actuated mechanism located above the case. The rear minor flap must be folded before it reaches the stationary plow used to fold the front minor flap and before the major flaps are folded.

Thus, there is a need in the art for a positive method and device to fold the flaps of an RSC without producing excessive friction and without skewing the case.

SUMMARY

In accordance with the purpose(s) of this invention, as embodied and broadly described herein, in one aspect, an apparatus for folding the flaps of a case is provided. In another aspect, the flap folding apparatus can comprise a pair of folding conveyors. In still another aspect, the flap folding apparatus can further comprise at least one of: a front flap folding mechanism, a rear flap folding mechanism, a bottom conveyor, and a tape head unit.

The pair of folding conveyors can be configured for folding the major flaps of the case. In one aspect, each folding conveyor of the pair of folding conveyors can be positioned on opposite sides of a machine axis. Each folding conveyor can comprise a downstream section, an upstream section, and a continuous belt configured to travel over the upstream section and the downstream section. In one aspect, the downstream section of each folding conveyor can extend substantially parallel to the machine axis and along a downstream conveyor plane. The upstream section of each folding conveyor is connected to its respective downstream section. In another aspect, the upstream section of each folding conveyor can extend at an acute angle relative to the machine axis and can extend upwards at an acute angle relative to the downstream conveyor plane. In still another aspect, a portion of the continuous belt can be positioned at an acute angle with respect to a machine plane that bisects the machine axis and that is transverse to the downstream conveyor plane.

In use, a front edge of the major flaps of a case can contact a respective inside belt edge of the continuous belts of the folding conveyors. Because the upstream section of the folding conveyors are positioned at an acute angle relative to the bottom conveyor, as the case is urged towards the downstream section of the flap folding apparatus, the distance between the folding conveyors and the bottom conveyor decreases, thereby urging the major flaps to the closed position.

Additional advantages will be set forth in part in the description which follows, and in part will be obvious from the description, or may be learned by practice of the aspects of the invention as described herein. The advantages can be realized and attained by means of the elements and combinations particularly pointed out in the appended claims. It is to be understood that both the foregoing general description and the following detailed description are exemplary and explanatory only and are not restrictive of the aspects of the invention, as claimed.

BRIEF DESCRIPTION OF THE DRAWINGS

The accompanying drawings, which are incorporated in and constitute a part of this specification, illustrate aspects of the invention and, together with the description, serve to explain the principles of the invention.

DETAILED DESCRIPTION

Figure 1:
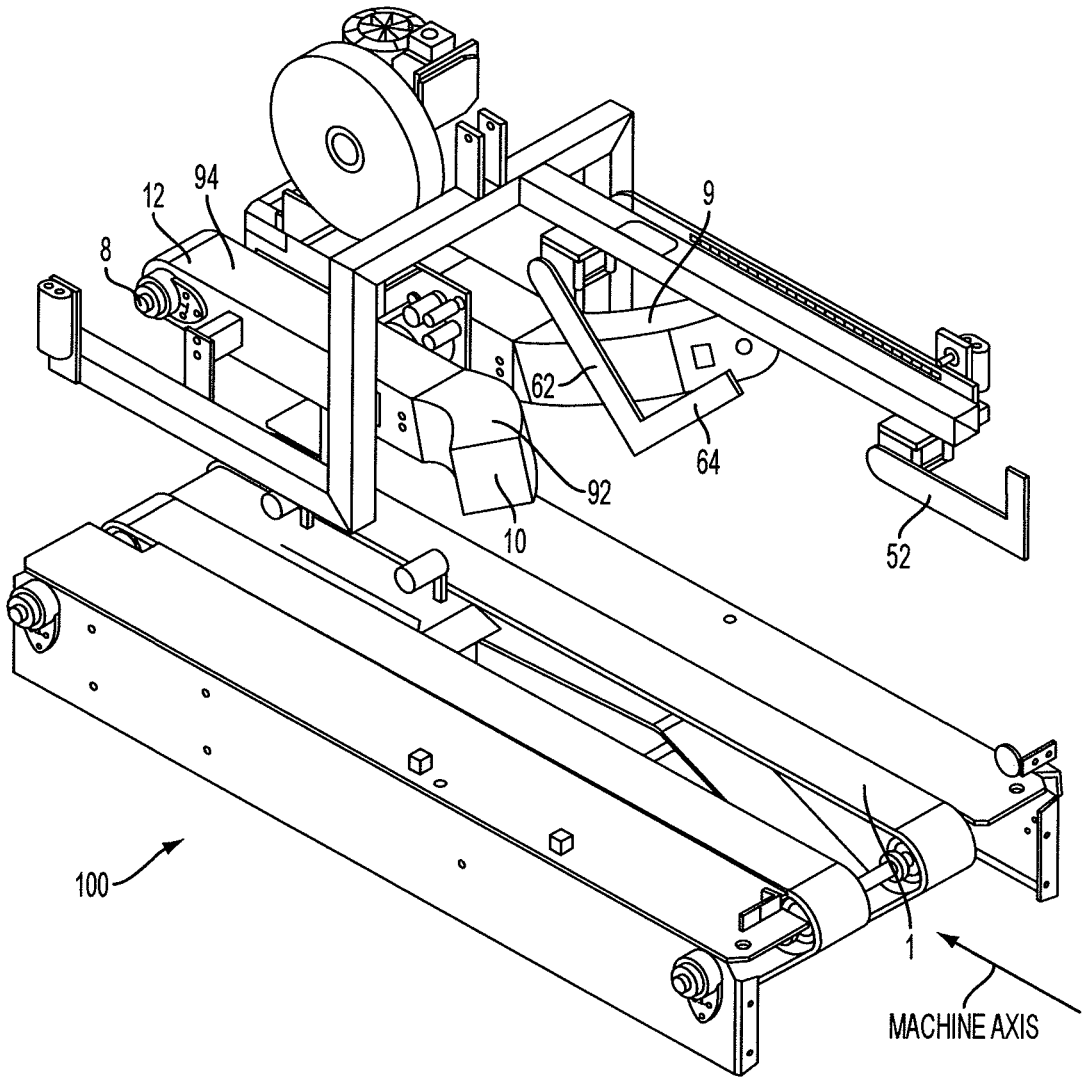
FIG. 1 is a perspective view of a flap folding apparatus of the present application, according to one aspect.

The present invention may be understood more readily by reference to the following detailed description of aspects of the invention and to the Figures and their previous and following description.

The present invention may be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

As used in the specification and the appended claims, the singular forms "a," "an" and "the" include plural referents unless the context clearly dictates otherwise. Thus, for example, reference to a "conveyor" can include two or more such conveyors unless the context indicates otherwise.

Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Reference will now be made in detail to the present preferred aspect(s) of the invention, examples of which are illustrated in the accompanying drawings. Wherever possible, the same reference numbers are used throughout the drawings to refer to the same or like parts.

In one aspect, an apparatus 100 is provided for folding the flaps of a box, such as for example and without limitation, an RSC 200. Although used herein to describe the folding of flaps of an RSC, it is contemplated that the flap folding apparatus can be used to fold materials other than corrugated cardboard, and packages other than a box. The flap folding apparatus 100, in one aspect, can comprise a pair of folding conveyors 9, 10. In another aspect, the flap folding apparatus can further comprise at least one of: a front flap folding mechanism 6, a rear flap folding mechanism 5, a bottom conveyor 1, and a tape head unit 110.

Figure 2:
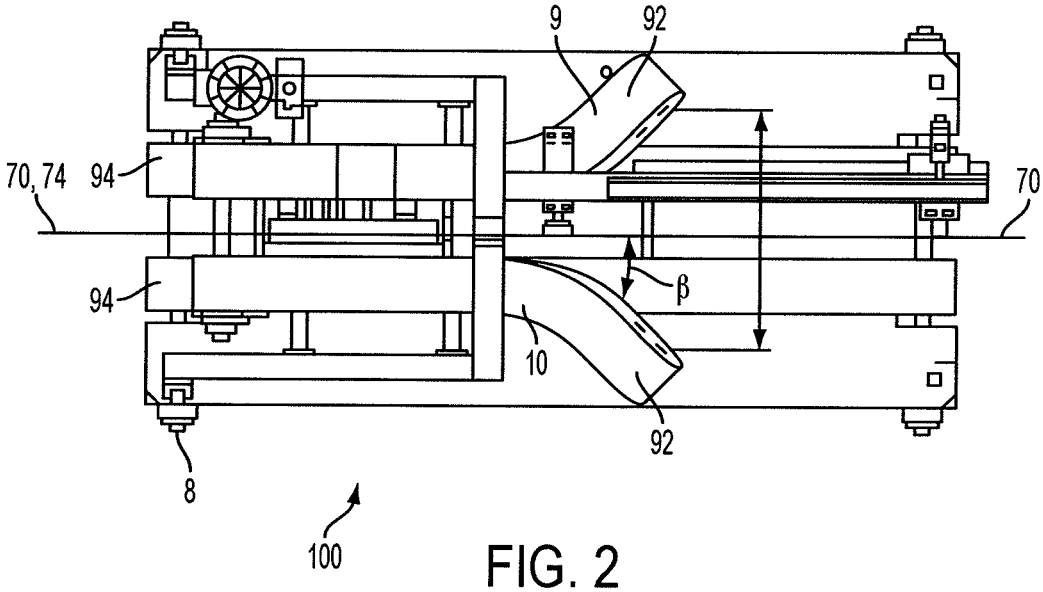
FIG. 2 is plan view of the flap folding apparatus of FIG. 1.

In one aspect, the pair of folding conveyors 9, 10 can comprise a first folding conveyor 9 and a second folding conveyor 10. In another aspect, each folding conveyor of the pair of folding conveyors 9, 10 can comprise an upstream section 92 connected to a downstream section 94 and a continuous belt 12 configured to travel over the upstream and downstream sections. In another aspect, the continuous belt can be configured to engage at least a portion of a major flap 204 of an RSC 200. As illustrated in FIGS. 1 and 2, the folding conveyors can be spaced from a longitudinal machine axis 70 extending through the center of the flap folding apparatus 100 in the direction of RSC travel. In another aspect, the folding conveyors 9, 10 can be mirror images of each other.

In one aspect, at least a portion of the bottom conveyor 1 can be substantially planar, though it is also contemplated that at least a portion of the bottom conveyor can be nonplanar. In other aspects, the bottom conveyor can be a single conveyor, or alternatively, a plurality of bottom conveyors as illustrated in FIG. 1.

In one aspect, the continuous belt 12 of the folding conveyors 9, 10 can have an exposed surface 121 and an inside belt edge 122. In another aspect, a portion of the exposed surface of the continuous belt can be configured to be substantially planar as it passes over lower portions of the downstream and/or upstream sections of each folding conveyor. In one aspect, the continuous belt can be formed from polymeric materials, such as plastic, rubber and the like, such as those produced by Intralox, LLC of Harahan, La. In another aspect, each folding conveyor can be powered by a common shaft 8 and a common gearmotor 7. Thus, each belt of the folding conveyors 9, 10 can be driven at substantially the same speed relative to the other belt. The bottom conveyor 1 can be driven by a gearmotor 2. In another aspect, the continuous belt 12 of each folding conveyor and the bottom conveyor 1 can be driven at substantially the same speed relative to each other.

In one aspect, a lower surface 98 of the downstream section of the folding conveyor can have a longitudinal axis and be positioned substantially parallel to the machine axis 70 and along a downstream conveyor plane 72. It is of course contemplated that the downstream section can be positioned at an acute angle relative to the machine axis of the apparatus 100.

In another aspect, the downstream conveyor plane 72 can be spaced from the bottom conveyor 1 a predetermined distance. In another aspect, the downstream conveyor plane can be substantially parallel to the bottom conveyor, such that portions of the lower surface 98 of the downstream section 94 of the folding conveyors 9, 10 can be substantially parallel to the bottom conveyor. In another aspect, the predetermined distance between the downstream conveyor plane 72 and the bottom conveyor can be substantially the same as the height of a case 200. In another aspect, the predetermined distance can be slightly greater than the height of a case such that the case and at least one folded flap of the case can fit between the lower surface 98 of the downstream section 94 of the folding conveyors 9, 10 and the bottom conveyor 1. It is contemplated, however, that a portion of the downstream section of the folding conveyor can be positioned at an angle of between about 0 degrees and 30 degrees relative to the bottom conveyor. As will be discussed, in yet another aspect, the position of the folding conveyors 9, 10 relative to the bottom conveyor can be adjusted.

Figure 3:
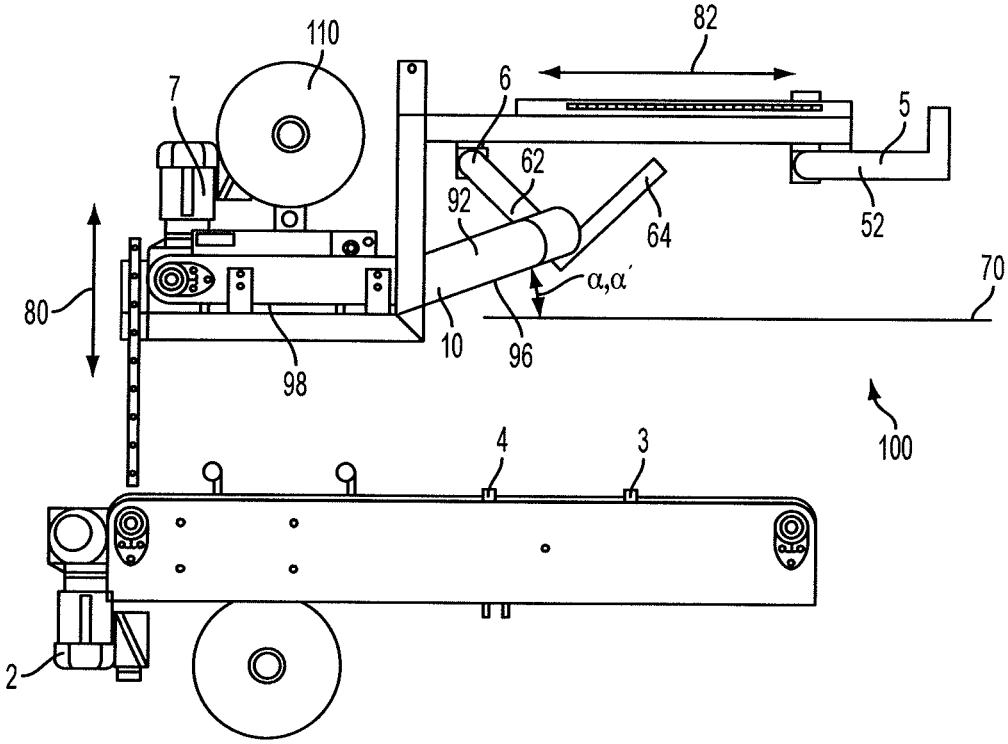
FIG. 3 is a side elevational view of the flap folding apparatus of FIG. 1.
Figure 4:
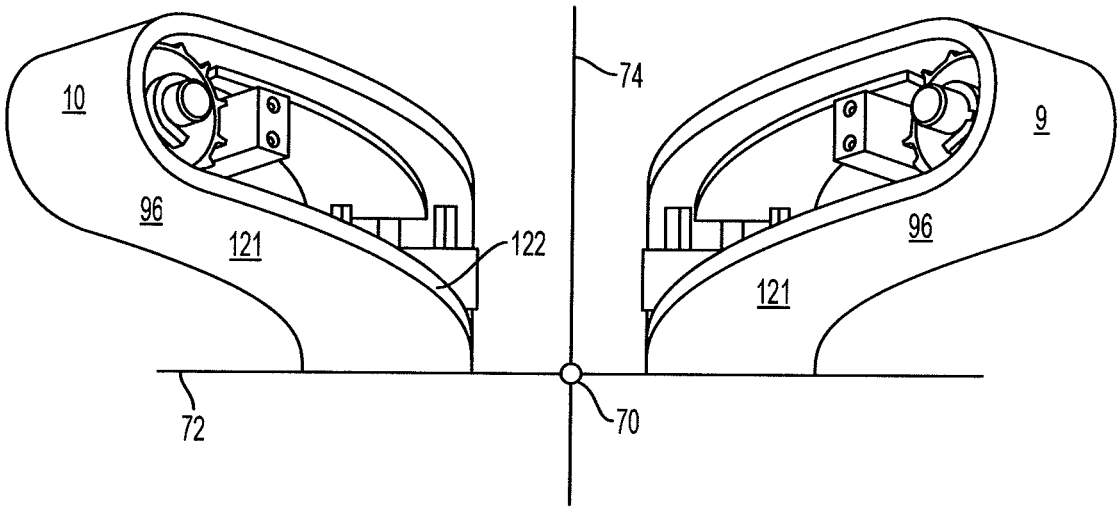
FIG. 4 is a front elevational view of the folding conveyors of the flap folding apparatus of FIG. 1.
Figure 5:
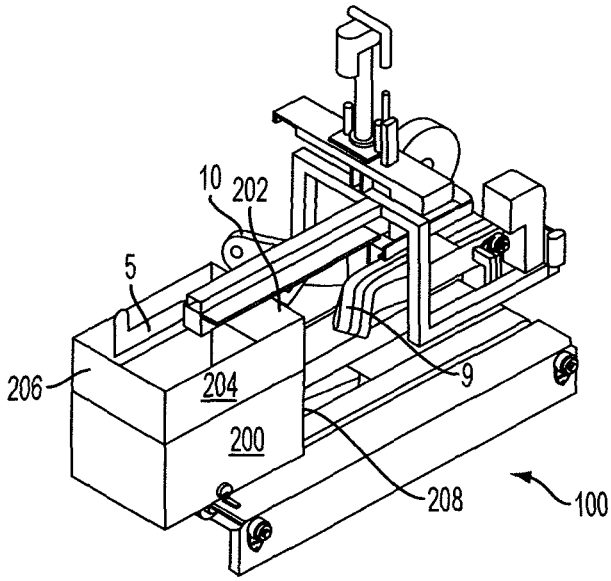
FIGS. 5-8 illustrate the flap folding apparatus of FIG. 1, folding the flaps of an RSC, according to one aspect.

As illustrated in FIG. 3, in one aspect, at least a portion of the upstream section 92 of the folding conveyors 9, 10 can extend upwards at an acute angle $\alpha$ relative to the downstream conveyor plane 72. Thus, in one aspect, at least a portion of the substantially planar exposed surface 121 of the continuous belt 12 of the folding conveyors 9, 10 can extend upwards at the acute angle $\alpha$ relative to the downstream conveyor plane 72. In another aspect, at least a portion of the exposed surface of the continuous belt 12 can be positioned at angle $\alpha$ of between about 5 and 85 degrees relative to the downstream conveyor plane. In yet another aspect, at least a portion of the exposed surface 121 can be positioned at an angle $\alpha$ of between about 10 and 60 degrees relative to the downstream conveyor plane. In another aspect, at least a portion of the exposed surface can be positioned at an angle $\alpha$ of between about 15 and 30 degrees relative to the downstream conveyor plane. In another aspect, at least a portion of the exposed surface of the continuous belt 12 can be positioned at an angle $\alpha$ of about 20 degrees relative to the downstream conveyor plane. As can be appreciated, portions of a lower surface 96 of the upstream section 92 of the folding conveyor can be spaced a greater distance from the bottom conveyor 1 than the lower surface 98 of the downstream section 94 of the folding conveyor 9, 10.

In one aspect, at least a portion of the upstream section 92 of the folding conveyors 9, 10 can extend upwards along an upstream conveyor plane that is at an acute angle $\alpha'$ relative to the downstream plane. In another aspect, at least a portion of the upstream conveyor plane can be positioned at angle $\alpha'$ of between about 1 and 85 degrees relative to the downstream conveyor plane. In yet another aspect, at least a portion of the upstream conveyor plane can be positioned at an angle $\alpha'$ of between about 5 and 60 degrees relative to the downstream conveyor plane. In another aspect, at least a portion of the upstream conveyor plane can be positioned at an angle $\alpha'$ of between about 10 and 30 degrees relative to the downstream conveyor plane. In another aspect, at least a portion of the upstream conveyor plane can be positioned at an angle $\alpha'$ of about 20 degrees relative to the downstream conveyor plane.

In one aspect, and as illustrated in FIG. 2, at least a portion of the upstream section 92 of the folding conveyor 9, 10 can be positioned at an acute angle β relative to the machine axis 70. In another aspect, at least a portion of the upstream section 92 of the folding conveyor can be positioned at angle β of between about 5 and 85 degrees relative to the machine axis. In yet another aspect, at least a portion of the upstream section of the folding conveyor 9, 10 can be positioned at an angle β of between about 20 and 70 degrees relative to the machine axis 70. In another aspect, at least a portion of the upstream section of the folding conveyor can be positioned at an angle β of between about 30 and 60 degrees relative to the machine axis. In another aspect, at least a portion of the upstream section of the folding conveyor can be positioned at an angle β of about 45 degrees relative to the machine axis.

The upstream section 92 of each folding conveyor can extend away from the machine axis 70, and thus, away from the upstream section of the opposed folding conveyor 9, 10. In one aspect, the upstream section 92 can extend away from the machine axis a predetermined distance. This distance can be configured so that cases having different widths can be processed. For example, the upstream section 92 can extend away from the machine axis a predetermined distance such that a 6 inch wide RSC 200, a 12 inch wide RSC, a 16 inch wide RSC, and an RSC having a width less than 6 inches or greater than 16 inches can be processed by the apparatus 100.

In one aspect, at least a portion of the upstream section 92 of each folding conveyor 9, 10 can be arcuate in shape having a radius between about 1 inch and 36 inches. In another aspect, the radius of at least a portion of the upstream section can be between about 6 inches and 18 inches. In another aspect, the radius of at least a portion of the upstream section can be about 9 inches.

In another aspect, each folding conveyor 9, 10 can further comprise a support frame configured to position the continuous belt 12 in the desired positions. In still another aspect, the frame can be an adjustable frame such that the position of the continuous belt as it travels over the front and downstream sections can be adjusted to predetermined locations. According to another aspect, the adjustable frame can adjust the desired position and/or orientation of the folding conveyor 9, 10 relative to the bottom conveyor 1 and/or the machine axis 70 of the apparatus 100. For example, the distance between the continuous belt of the folding conveyors and the bottom conveyor 1 can be varied, as illustrated by arrow 80 in FIG. 3.

In one aspect, a portion of the exposed surface 121 of the continuous belt 12 traveling over the downstream section 94 and/or the upstream section 92 of each folding conveyor 9, 10 can be substantially normal to a machine plane 74 that bisects the machine axis 70 and that is transverse to the downstream conveyor plane 72.

In one aspect, the front flap folding mechanism 6 can comprise a front flap arm 62 and an actuator to actuate the front flap arm. In another aspect, the front flap arm can be actuatable between a first position, in which a contacting portion 64 of the front flap arm can be positioned at an acute angle relative to the downstream conveyor plane 72, and a second position, in which the contacting portion of the front flap arm can be positioned in a plane substantially parallel to the downstream conveyor plane. In still another aspect, the front flap arm 62 can be actuatable through a range of about 45 degrees. It is contemplated, however, that the front flap arm can be actuatable through a range of about 90 degrees. As will be described more fully below, when an RSC 200 is being processed through the apparatus 100, the front flap folding mechanism 6 can fold the front flap 202 of the RSC and maintain the front flap in a folded position until the major flaps 204 of the RSC can maintain the front flap in the folded position. In still another aspect, the front flap arm 62 can be dimensioned to complete the folding of the rear minor flap 206 and maintain the rear flap in a folded position until the major flaps 204 of the RSC can maintain the rear flap in the folded position In one aspect, the rear flap folding mechanism 5 can comprise a rear flap arm 52 and an actuator configured to actuate the rear flap arm. In another aspect, the rear flap arm can be actuatable between a first position, in which the rear flap arm can be positioned such that a front flap 202 of an RSC 200 can pass by the rear flap arm 52 without contacting the rear flap arm, and a second position is which the rear flap arm can fold the rear flap 206 of the RSC and maintain the rear flap in a folded position until the major flaps 204 of the RSC 200 can maintain the rear flap 206 in the folded position. In still another aspect, in the second position, a portion of the rear flap arm 52 can be positioned in a plane substantially parallel to the downstream conveyor plane 72. In another aspect, the rear flap arm can be actuatable through a range of about 45 degrees. It another aspect, the rear flap arm 52 can be actuatable through a range of about 90 degrees. According to another aspect, the rear flap folding mechanism 5 can be adjusted to a predetermined distance so that RSCs of varying lengths can be processed, as illustrated by arrow 82 in FIG. 3. As will be described more fully below, when an RSC is being processed through the apparatus 100, the rear flap folding mechanism can fold the rear flap 206 of the RSC 200 and maintain the rear flap in a folded position until the major flaps 204 of the RSC can maintain the rear flap 206 in the folded position.

FIGS. 5-8 illustrate the flap folding apparatus in use, according to one aspect. Initially, the rear flap folding mechanism 5 can adjusted to the predetermined distance for the length of the case to be processed, and the folding conveyors 9, 10 can be adjusted so that the lower surface 98 of the downstream section 94 of each folding conveyor is positioned the predetermined distance from the bottom conveyor 1 for the height of the case 200 to be processed.

A case can enter the apparatus 100 being conveyed on the bottom conveyor 1. In one aspect, as the case is being conveyed, a first photoeye 3 can detect a leading edge 208 of the case. In another aspect, the first photoeye can be positioned to allow the top of the front minor flap 202 of the case to be very close to making contact with the front flap arm 62 before sending an actuation signal to the front and rear minor flap actuators. In another aspect, a delay timer can be used so that the front and minor flap actuators are activated a predetermined amount of time after the first photoeye 3 detects the leading edge of the case 200. After actuation, the contacting portion 64 of the front flap arm 62 contacts the front minor flap and urges the front minor flap 202 to a closed position as the front flap arm rotates from the first position to the second position. Similarly, after actuation, the rear flap arm 52 contacts the rear minor flap 206 and urges the rear minor flap to a closed position as the rear flap arm rotates from the first position to the second position. In the second position, both the front and rear flap arms maintain the front and rear minor flaps in the folded position.

As the case 200 continues moving along the machine axis 70 through the apparatus 100, in one aspect, a second photoeye 4 can detect the leading edge 208 of the case and signal the front and rear minor flap actuators to return to their respective first positions. In another aspect, the second photoeye can be positioned such that the two major flaps 204 of the RSC make contact with the folding conveyors 9, 10 and begin folding the major flaps before the front and rear minor flap actuators return to their respective first positions. Once the major flaps have started to fold after making contact with the folding conveyors, the two minor flap folding actuators can return to their respective first positions because the minor flaps 202, 206 will be held in position by the two major flaps, even though the two major flaps 204 have only been partially folded at this point.

Figure 6:
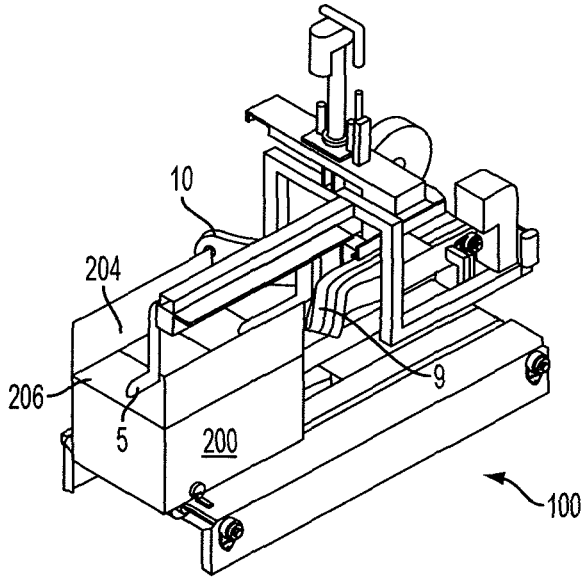
Figure 7:
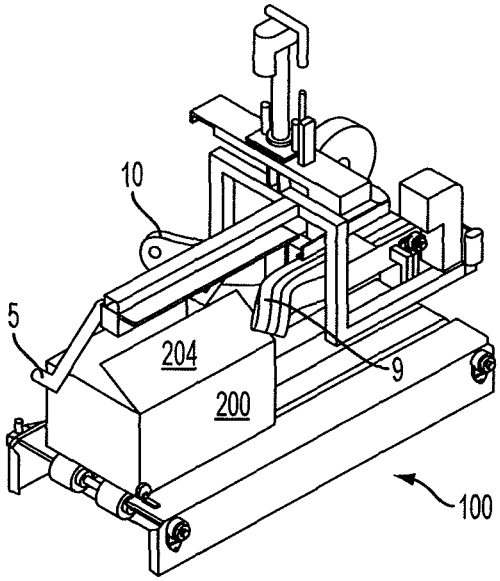

In order to fold the major flaps, the bottom conveyor 1 can convey the RSC 200 until a front side edge of the major flaps 204 of the RSC contacts the inside belt edge 122 of the continuous belt 12 of either the first or second folding conveyor 9, 10, as illustrated in FIG. 6. Because the upstream section 92 of the folding conveyors are positioned at an acute angle relative to the bottom conveyor 1, as the RSC 200 travels upon the bottom conveyor, the exposed surface 121 of the continuous belt 12 begins to contact the major flaps 204, as illustrated in FIG. 7. Additionally, as the RSC travels upon the bottom conveyor, the distance between the folding conveyors and the bottom conveyor 1 decreases, thereby urging the major flaps 204 to the closed position. Because the continuous belt of each folding conveyor 9, 10 and the bottom conveyor 1 are traveling at substantially the same speed, very little friction is created between the RSC and the folding conveyors 9, 10.

Figure 8:
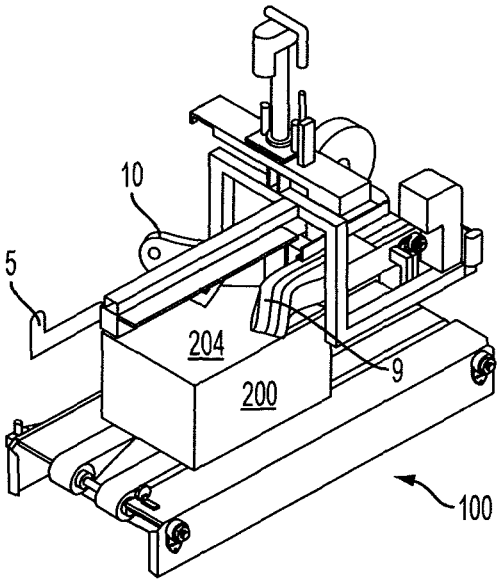

As illustrated in FIG. 8, the RSC 200, with its flaps in the closed position, can continue through the apparatus 100. In one aspect, tape can be applied to the top of the case to secure the flaps with a conventional tape heat unit 110, such as, for example and without limitation, the Dekka 22 manufactured by Dekka Industries, Richmond, British Columbia, Canada. After taping, the RSC can exit the apparatus.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for folding the flaps of a case comprising:

providing an apparatus for folding the flaps of a case, the apparatus having a machine axis and comprising:

a pair of folding conveyors configured for folding the major flaps of the case, wherein the pair of folding conveyors comprises a first folding conveyor and an opposed second folding conveyor, wherein the respective first and second folding conveyors are positioned on opposite sides of the machine axis, and wherein each folding conveyor comprises:

a downstream section that extends substantially parallel to the machine axis and along a downstream conveyor plane;

an upstream section connected to the downstream section that extends at an acute angle relative to the machine axis and extend upwards at an acute angle relative to the downstream conveyor plane; and a continuous belt configured to travel over the upstream section and the downstream section, wherein the continuous belt has an exposed surface and an inside belt edge substantially normal to the exposed surface, and wherein an elongated portion of the exposed surface is substantially planar as the exposed surface passes over lower portions of the downstream and upstream sections of each folding conveyor; and supplying a case having flaps to the apparatus and into operative engagement with the respective upstream sections of the pair of folding conveyors, wherein supplying a case into operative engagement with the respective upstream sections of the pair of folding conveyors comprises the case contacting the inside edge of the continuous belt.

2. The method of claim 1, wherein the apparatus further comprises a bottom conveyor, wherein the bottom conveyor is opposed to the pair of folding conveyors and is positioned substantially parallel to the downstream conveyor plane.

3. The method of claim 2, wherein the apparatus further comprises means for selectively folding the front flap of the case.

4. The method of claim 3, wherein the means for selectively folding the front flap of the case comprises a front flap arm and an actuator coupled to the front flap arm that is configured to selectively actuate the front flap arm.

5. The method of claim 3, wherein the apparatus further comprises means for folding the rear flap of the case.

6. The method of claim 5, wherein the means for folding the rear flap of the case comprises a rear flap arm and an actuator coupled to the rear flap arm that is configured to selectively actuate the rear flap arm.

7. The method of claim 2, wherein the bottom conveyor and the pair of folding conveyors are driven at substantially the same speed relative to each other.

8. The method of claim 1, wherein the upstream section of each folding conveyor extends at an angle of between 20 and 70 degrees relative to the machine axis.

9. The method of claim 8, wherein the upstream section of each folding conveyor extends at an angle of between 40 and 50 degrees relative to the machine axis.

10. The method of claim 1, wherein the upstream section of each folding conveyor extends at an angle of between 5 and 60 degrees relative to the downstream conveyor plane.

11. The method of claim 1, wherein a portion of the upstream section of each folding conveyor is arcuate.

12. The method of claim 2, wherein a lower surface of the downstream section is positioned a predetermined distance from the bottom conveyor.

13. The method of claim 12, wherein the predetermined distance is adjustable.

14. The method of claim 1, wherein the inside belt edge of the first folding conveyor faces the inside belt edge of the second folding conveyor as the inside belt edge of the first folding conveyor passes over lower portions of the downstream and upstream sections of the first folding conveyor.

* * * * *